United States Patent [19]

Kuhl

[11] Patent Number: 4,702,777

[45] Date of Patent: Oct. 27, 1987

[54] METHOD AND APPARATUS FOR HIGH CAPACITY WASHING, SANITIZING AND DRYING OF STACKS OF FLATS

[76] Inventor: Henry Y. Kuhl, Kuhl Rd., P.O. Box 26, Flemington, N.J. 08822

[21] Appl. No.: 866,678

[22] Filed: May 27, 1986

[51] Int. Cl.[4] ..... B08B 3/02; B08B 3/04; B08B 7/04

[52] U.S. Cl. ..... 134/25.3; 134/60; 134/95; 134/99; 134/153; 134/155; 134/158

[58] Field of Search ..... 134/25.1, 25.2, 25.3, 134/25.4, 32, 33, 60, 95, 99, 103, 141, 153, 155, 158

[56] References Cited

U.S. PATENT DOCUMENTS

| | | | |
|---|---|---|---|
| 2,416,475 | 2/1947 | Friedman | 134/158 |
| 3,349,419 | 10/1967 | Kuhl et al. | 15/3.13 |
| 3,415,257 | 12/1968 | Wellman | 134/98 |
| 3,615,822 | 10/1971 | Molinari | 134/23 |
| 3,631,605 | 1/1972 | Wylie | 34/9 |
| 3,736,948 | 6/1973 | Crosswhite | 134/95 |
| 3,926,666 | 12/1975 | McInnes | 134/33 |
| 3,998,656 | 12/1976 | Grotto | 134/33 |
| 4,064,635 | 12/1977 | Kuhl | 34/58 |
| 4,134,215 | 1/1979 | Kuhl | 34/8 |
| 4,164,296 | 8/1979 | Trees | 414/416 |

*Primary Examiner*—Philip R. Coe
*Assistant Examiner*—Corinne Reinckens
*Attorney, Agent, or Firm*—Sperry, Zoda & Kane

[57] ABSTRACT

An apparatus is disclosed for washing, sanitizing and drying stacks of flats used for carrying various items, particularly eggs. The apparatus includes a dual station defining dual processing chambers. Since the flats are washed while in stacks, the capacity for this apparatus and method is quite high. Also one or several stacks of flats is constantly being processed within one of the two processing chambers while the other processing chamber is being set up for the next step. A stack of flats is initially placed within the first processing chamber and is then flooded with cleaning solution. The stack of flats is rotationally moved for cleaning. During this washing operation another stack of dirty flats is placed within the second processing station. When the washing within the first processing station is completed, the cleaning solution therein is pumped into the second processing station. Then the second processing station initiates the washing rotational movement and the first processing station has rinsing solution and then sanitizing solution sprayed upon the stack of flats. Then a high speed rotational dry is performed within the first processing station and the flats are removed. The first processing station is then ready to receive the next stack of flats to be cleaned. Once the washing is completed in the second processing station the washing solution is pumped therefrom into the first processing station for washing therein. At that time, the rinsing, sanitizing and drying step is performed within the second processing station.

22 Claims, 2 Drawing Figures

METHOD AND APPARATUS FOR HIGH CAPACITY WASHING, SANITIZING AND DRYING OF STACKS OF FLATS

BACKGROUND OF THE INVENTION

1. Field of the Invention

The present invention deals with the field of devices for cleaning of individual flats which are designed for carrying articles therein and in particular for carrying eggs. Normally these flats are placed upon some type of a conveyor system and pass through a wash station which individually washes each empty flat. However, under certain operating systems and when operating within certain financial constraints it becomes necessary to provide a higher capacity washing and sanitizing system which performs upon stacks of flats rather than individual flats. The present invention directly addresses this problem.

2. Description of the Prior Art

Prior art devices as described above are normally usable for cleaning, sanitizing and drying flats individually. The present invention, however, is particularly usable for washing of stacks of flats. Normally when the flats are stacked there is enough space in between adjacent flats to allow cleaning solution to pass therein. Prior art devices have not successfully provided any particular structure useful for the cleaning of trays or flats when so stacked. The present invention provides a novel means of agitation of the flats when in the stack configuration and also provide a novel recirculating means for the washing solution. The low cost and high volume of the apparatus and method of the present invention are particularly advantageous.

SUMMARY OF THE INVENTION

The present invention provides an apparatus for high capacity washing, sanitizing and drying of flats. In particular, the apparatus of the present invention includes a housing which defines therein a first processing station and a second processing station. The first processing station defines a first processing chamber therein and the second processing station defines a second processing chamber therein.

A first table means is positioned within the first processing station and is adapted to receive a stack of flats positioned thereon. This first table means is rotatably movable and is connected with respect to a first drive means to achieve this rotational movement. This movement may be pure rotational movement or reciprocating back and forth rotational movement sometimes referred to as "agitation".

A rotatably movable second table means is positioned within the second processing station and is adapted to receive a stack of flats positioned thereon also. A second drive means is connected with respect to the second table means to selectively cause rotational movement thereof which may again be pure rotation or agitation.

A pump is in fluid flow communication with respect to the first processing chamber and the second processing chamber and is adapted to pump cleaning solution between these two chambers.

A first wash line is in fluid flow communication with respect to the output of the pump means the first processing chamber and similarly a second wash line is in fluid flow communication with respect to the pump means and the second processing station.

A cleaning solution source means is positioned in fluid flow communication with respect to the first processing chamber means to initially supply cleaning solution thereto. A first sanitizing spray conduit means is positioned within the first processing chamber means and defines a plurality of first apertures therealong to selectively dispense rinsing or sanitizing solution upon stacks of flats positioned within the first processing chamber and particularly rotating therein.

Similarly, a second sanitizing spray conduit is positioned within the second processing chamber means and defines a plurality of second aperture means therealong for selective dispensing of solutions therefrom upon stacks of flats which normally will be positioned therein for rotational movement.

A sanitizing spray supply means is selectively in fluid flow communication with respect to the first sanitizing spray conduit and the second sanitizing spray conduit for supplying sanitizing solution thereto.

Preferably the housing will comprise a single integral unit which encases both the first processing chamber and the second processing chamber. Also, the pump means may be a reversible pump to selectively transfer cleaning solution back and forth between the two processing chambers.

Preferably the first and second drives will be capable of increasing the rotational velocity of the stack of flats during sanitizing and rinsing when compared with the speed of rotation during washing. Furthermore preferably the first and second drive means will be capable of a further increase in speed of rotational velocity to facilitate the drying step.

In the preferred configuration of the present invention, the first processing station includes the capability for receiving two individual stacks therein and the second processing station has the capability of receiving two stacks for processing therein. This is the preferred capacity which an operator can manually handle. The manual operations of loading and unloading the stack of eggs and of initiating the washing, rinsing, sanitizing or drying step normally provide continuous activity for a single individual wherein two individual stacks are capable of being positioned within each of the processing stations.

It is an object of the present invention to provide a method and apparatus for high capacity washing, rinsing, sanitizing and drying of stacks of flats wherein a cleaning operation is performed upon a stack of flats similar in quality to a cleaning operation capable of being performed by a washing system usable for washing flats individually.

It is an object of the present invention to provide a method and apparatus for high capacity washing, rinsing, sanitizing and drying of stacks of flats wherein a great number of flats can be washed within a relatively minimal amount of time.

It is an object of the present invention to provide a method and apparatus for high capacity washing, rinsing, sanitizing and drying of stacks of flats wherein maintenance requirements are minimized.

It is an object of the present invention to provide a method and apparatus for high capacity washing, rinsing, sanitizing and drying of stacks of flats wherein the initial cost of capital set up of the system is minimal.

It is an object of the present invention to provide a method and apparatus for high capacity washing, rinsing, sanitizing and drying of stacks of flats wherein washing, rinsing, sanitizing and spin-drying of a stack of flats are performed without any manual movement of the stack of flats in between these individual steps.

It is an object of the present invention to provide a method and apparatus for high capacity washing, rinsing, sanitizing and drying of stacks of flats wherein washing can be performed by reciprocal rotational agitation.

It is an object of the present invention to provide a method and apparatus for high capacity washing, rinsing, sanitizing and drying of stacks of flats wherein sanitizing, rinsing and drying are performed at high rotational velocities in washing.

It is an object of the present invention to provide a method and apparatus for high capacity washing, rinsing, sanitizing and drying of stacks of flats wherein drying is performed at a higher rotational velocity than rinsing or sanitizing.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
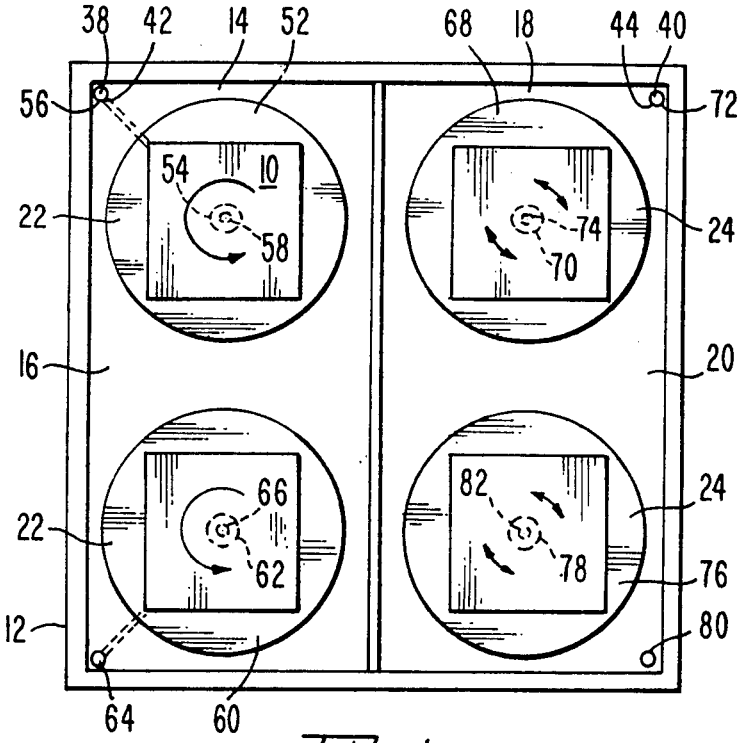
FIG. 1 is a top plan view of a preferred embodiment of the apparatus for high capacity washing, sanitizing and drying of stacks of flats embodying the present invention.
Figure 2:
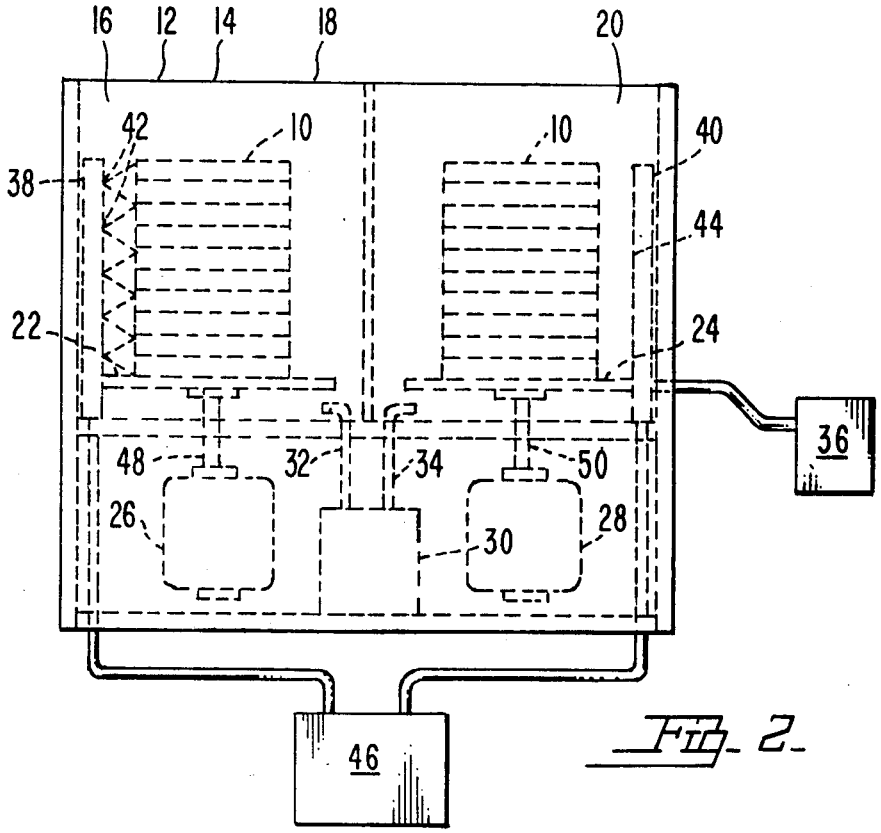
FIG. 2 is a front plan view of the embodiment shown in FIG. 1.

The present invention provides an apparatus and method for high capacity washing, sanitizing and drying of stacks of flats 10 when positioned upon rotating tables within a housing 12. Each housing 12 will preferably define a first processing station 14 and a second processing station 18 therein. First processing station 14 will define a first processing chamber 16 therein and second processing station 18 will define a second processing chamber 20 therein.

The first processing chamber 16 and the second processing chamber 20 can define more than one particular location for receiving a stack of flats 10. That is each individual processing station can receive more than one stack of flats, however, the most advantageous appreciated at the present time is the positioning of two stacks 10 of flats within each processing station.

First processing station 14 defines a first table means 22 therein adapted to receive a stack of flats 10 positioned thereon.

Second processing station 18 includes a second table means 24 therein adapted to receive a stack of flats 10 thereon. First table means 22 is fixedly secured preferably through a first drive shaft means 48 to a first drive means 26 for achieving rotational movement thereof. Similarly, second table means 24 is preferably fixedly secured to a second drive shaft means 50 to second drive means 28 for achieving rotational motion thereof.

A pump means 30 is positioned in fluid flow communication with respect to first processing chamber 16 and second processing chamber 20. This pump means is connected through a first wash line 32 to first processing chamber 16 and is connected to a second wash line 34 to second processing chamber 20. In this manner, pump means 30 which may preferably be a reversible pump can remove a washing solution from one of the two processing chambers and pump that washing solution into the other processing chamber. This operation can be performed back and forth a number of times to reuse the washing solution repeatedly until it is completely spent or dirty. Initially, a cleaning solution supply source 36 will supply cleaning solution to one of the processing chambers to initiate the back and forth pumping by pump means 30.

A first sanitizing spray conduit means 38 will be positioned within first processing chamber 16. Conduit 38 will be in fluid flow communication with respect to sanitizing spray supply means 46 in order to receive initially rinsing spray and later sanitizing spray therefrom. These solutions are dispensed by conduit 38 through a plurality of first aperture means 42 positioned vertically therealong. The aperture means 42 are positioned on the conduit in a location such that solution sprayed therefrom will contact the stack of flats positioned upon first table means 22.

In a similar manner, second sanitizing spray conduit means 40 will be positioned within second processing chamber 20 and will be in fluid flow communication with respect to sanitizing spray supply means 46 to receive selectively a rinsing or sanitizing solution therefrom. Second conduit means 40 will include a plurality of second aperture means 44 therealong to dispense the rinsing or sanitizing solution toward a stack of flats 10 positioned upon second table means 24.

In the preferred configuration of the present invention, the first processing chamber 16 will define two locations each capable of receiving a stack of flats simultaneously and preferably having full fluid flow communication therebetween for simultaneous filling of washing solution therein. With this configuration, the first table means 22 will include a first upstream table 52 and a first downstream table 60. Each table will be associated with an individual drive means and in particular first upstream table 52 will be interconnected by a first upstream drive shaft 58 with a first upstream drive 54. Also a first downstream table 60 will be interconnected to a first downstream drive 62 by way of a first downstream drive shaft 66.

Also the first sanitizing spray conduit means 38 will comprise two individual conduit members, namely a first upstream sanitizing spray conduit 56 defined adjacent to the first upstream table 52 and a first downstream sanitizing spray conduit 64 positioned adjacent to a first downstream table 60.

In a similar manner, the second processing station 18 will preferably include the capability for receiving two individual stacks of flats 10 therein. With this configuration, the second table means 24 will particularly include a second upstream table 68 as well as second downstream table 76. Second upstream table 68 will be interconnected through a second upstream drive shaft 74 to the second upstream drive 70. In a similar manner, the second downstream table 76 will be interconnected through a second downstream drive shaft 82 to the second downstream drive 78.

The second sanitizing spray conduit means 40 will actually comprise two individual conduit members, namely a second upstream sanitizing spray conduit 72 and a second downstream sanitizing spray conduit 80. Conduit 72 will be positioned adjacent to the second upstream table to dispense rinsing and sanitizing solution thereon. Similarly, second downstream sanitizing spray conduit 80 will be positioned adjacent to second downstream table 76 to dispense rinsing and sanitizing solution to a stack of flats 10 positioned thereon.

The operation of the apparatus described above will be performed by the following method. Initially, cleaning solution will be allowed to enter the second processing chamber 20 through cleaning solution source means 36. Once the apparatus is in this condition, it is ready to receive a stack of flats 10 to be positioned within the first processing chamber 16 upon first table means 22. In actuality, in a preferred configuration the first processing chamber 16 will include two individual tables 52 and 60 to receive two individual stacks of flats 10. Once these flats are in position, the pump means 30 will be actuated to remove the cleaning solution from the second processing chamber 20 and pump the same solution into the first processing chamber 16. Thereafter, first drive means 26 will initiate operation causing low speed rotation or rotational reciprocation such as agitation of first table means 22. This will achieve washing of the stack or stacks of flats 10 positioned at that time within first processing chamber 16.

The washing step within the first processing chamber 16 will be performed for a given amount of time and during that time the operator will be able to place a second stack or stack of flats 10 within the second processing station 18 which is now empty having had the cleaning solution pumped therefrom. Once second processing station 18 is loaded, the washing step within first processing station 14 will normally be concluded.

At this point, pump means 30 is reversed and again actuated to remove cleaning solution from first processing chamber 16 and pump it into second processing chamber 20. Then second drive means 28 is actuated to initiate washing within second processing chamber 20 similar to that just immediately concluded within first processing chamber 16.

Once all of the cleaning solution is pumped from first processing chamber 16, the first sanitizing spray conduit means will begin to release a rinsing solution onto the stack of flats positioned upon first table means 22. Also simultaneously therewith first drive means 26 will initiate a rotation of the first table means at a somewhat higher speed than rotation which may have been performed during washing and certainly without agitation. Once the stack of flats within first processing chamber 16 are rinsed, a sanitizing solution will be supplied thereto to sanitize the clean, wet stack of flats. Once sanitizing solution has been applied thereto, drive means 26 will initiate higher speed operation to dry the stack of flats by centrifugal rotation.

Once the stack of flats within the first processing chamber 16 are dried, they will be manually removed by the operator and a new stack of dirty flats will be placed therein. By this time, the washing operation performed upon the stack of flats 10 positioned upon second table means 24 will be concluded. In this manner, the pump means 30 will initiate operation and pump the cleaning solution from second processing chamber 20 into first processing chamber 16 such that washing can be again initiated within the first processing chamber and such that the rinsing, sanitizing and drying operations can be performed upon the stack of flats 10 positioned within the second processing chamber 20.

This method will then be continuously repeated in such a manner as to continuously provide for washing, rinsing, sanitizing, drying or manual manipulation of flats within both processing stations. In this manner, a high speed cleaning operation is performed upon a large number of stacked flats by an apparatus which conserves wash water by recycling thereof.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An apparatus for high capacity washing, sanitizing and drying of stacks of flats comprising:

(a) a housing means;

(b) a first processing station located within said housing means and defining a first processing chamber therein adapted to receive a stack of flats for processing therein;

(c) a second processing station located within said housing means and defining a second processing chamber therein adapted to receive a stack of flats for processing therein;

(d) a rotatably movable first table means positioned within said first processing station and adapted to receive a stack of flats positioned thereon;

(e) a rotatably movable second table means positioned within said second processing station and adapted to receive a stack of flats positioned thereon;

(f) a first drive means connected with respect to said first table means to selectively cause rotational movement thereof;

(g) a second drive means connected with respect to said second table means to selectively cause rotational movement thereof;

(h) a pump means in fluid flow communication with respect to said first processing chamber and said second processing chamber and adapted to pump cleaning solution therebetween;

(i) a first wash line in fluid flow communication with respect to said pump means and said first processing chamber;

(j) a second wash line in fluid flow communication with respect to said pump means and said second processing station;

(k) a cleaning solution source means in fluid flow communication with respect to said first processing chamber means to supply cleaning solution thereto;

(1) a first sanitizing spray conduit means positioned within said first processing chamber means and defining a plurality of first aperture means therealong for selective dispensing of solutions therefrom upon stacks of flats positioned therein; '(m) a second sanitizing positioned within said second processing chamber means and defining a plurality of second aperture means therealong for selective dispensing of solutions therefrom upon stacks of flats positioned therein; and (n) a sanitizing spray supply means selectively in fluid flow communication with respect to said first sanitizing conduit means spray conduit and said second sanitizing spray conduit.

2. The apparatus as defined in claim 1 wherein said housing is one integral unit encasing said first processing chamber and said second processing chamber.

3. The apparatus as defined in claim 1 wherein said pump means is a reversible pump to selectively transfer cleaning solution back and forth between said first processing chamber and said second processing chamber.

4. The apparatus as defined in claim 1 further including a first drive shaft means extending between said first drive means and said first table means to control movement thereof.

5. The apparatus as defined in claim 1 further including a second drive shaft means extending between said second drive means and said second table means to control movement thereof.

6. The apparatus as defined in claim 1 wherein said first drive means and said second drive means rotate said first table means and said second table means at a higher rotational velocity during rinsing, sanitizing and drying than during washing.

7. The apparatus as defined in claim 6 wherein said first drive means and said second drive means rotate said first table means and said second table means at a higher rotational velocity during drying than during rinsing and sanitizing.

8. The apparatus as defined in claim 1 wherein said first drive means and said second drive means oscillate said first table means and said second table means rotationally during washing.

9. The apparatus as defined in claim 8 wherein said first drive means and said second drive means rotate said first table means and said second table means at a higher rotational velocity during drying than during rinsing and sanitizing.

10. The apparatus as defined in claim 1 wherein said first table means comprises two separate first tables and wherein said first drive means comprises two separate first drives and wherein said first sanitizing spray conduit means comprises two separate spray conduits to receive two stacks of flats simultaneously for processing therein.

11. The apparatus as defined in claim 1 wherein said second table means comprises two separate second tables and wherein said second drive means comprises two separate second drives and wherein said second sanitizing spray conduit means comprises two separate spray conduits to receive two stacks of flats simultaneously for processing therein.

12. An apparatus for washing, sanitizing and drying of stacks of flats comprising:

(a) a single integral housing means;

(b) a first processing station located within said housing means and defining a first processing chamber therein adapted to receive two stacks of flats for processing therein;

(c) a second processing station located within said housing means and defining a second processing chamber therein adapted to receive two stacks of flats for processing therein;

(d) a rotatably movable first table means positioned within said first processing station and including two separate first tables therein to receive a stack of flats positioned on each of said tables;

(e) a rotatably movable second table means positioned within said second processing station and including two separate second tables therein to receive a stack of flats positioned on each of said tables;

(f) a first drive means with the output thereof fixedly secured with respect to said first table means to selectively cause rotational oscillation thereof during washing and to selectively cause counterclockwise rotational movement thereof during rinsing, sanitizing and drying, said first drive means including two separate drives each connected to one of said first tables of said first table means for driving thereof;

(g) a second drive means with the output thereof fixedly secured with respect to said second table means to selectively cause rotational oscillation thereof during washing and to selectively cause counterclockwise rotational movement thereof during rinsing, sanitizing and drying, said second drive means including two separate second drives each connected to one of said second tables for driving thereof;

(h) a reversible pump means in fluid flow communication with respect to said first processing chamber and said second processing chamber and adapted to pump cleaning solution therebetween;

(i) a first wash line in fluid flow communication with respect to said pump means and said first processing chamber;

(j) a second wash line in fluid flow communication with respect to said pump means and said second processing station;

(k) a cleaning solution source means in fluid flow communication with respect to said first processing chamber means to supply cleaning solution thereto;

(l) a first sanitizing spray conduit means positioned within said first processing chamber means and defining a plurality of first aperture means therealong for selective dispensing of solutions therefrom upon stacks of flats positioned therein;

(m) a second sanitizing spray conduit means positioned within said second processing chamber means and defining a plurality of second aperture means therealong for selective dispensing of solutions therefrom upon stacks of flats positioned therein; and (n) a sanitizing spray supply means selectively in fluid flow communication with respect to said first sanitizing spray conduit and said second sanitizing spray conduit.

13. A method for high capacity washing, sanitizing and drying of stacks of flats comprising:

(a) placing a first stack of flats to be cleaned into a first of two adjacently positioned processing chambers;

(b) removing of cleaning solution from the second of two adjacently positioned processing chambers;

(c) filling the first processing chamber with the cleaning solution removed from the second processing chamber;

(d) rotationally moving the first stack of flats within the first processing station for washing thereof;

(e) placing a second stack of flats to be cleaned into the second processing chamber;

(f) removing of cleaning solution from the first processing chamber;

(g) filling the second processing chamber with the cleaning solution removed from the first processing chamber;

(h) rotationally moving the second stack of flats within the second processing station for washing thereof;

(i) rotating the first stack of flats within the first processing station;

(j) rinsing the rotating first stack of flats with rinsing solution;
(k) drying the first stack of flats by rotation thereof within the first processing station;
(l) removing of the first stack of flats from the first processing station;
(m) placing a third stack of flats into the first processing station;
(n) removing of cleaning solution from the second processing station;
(o) filling of the first processing station with cleaning solution removed from the second processing station;
(p) rotating the second stack of flats within the second processing station;
(q) rinsing the rotating second stack of flats with rinsing solution;
(r) drying the second stack of flats by rotation thereof within the second processing station; and
(s) removal of the second stack of flats from the second processing station.

14. The method as defined in claim 13 wherein said rotationally moving the first stack of flats within the first processing station for washing is continuously reversing rotational agitation.

15. The method as defined in claim 14 wherein said rotationally moving the second stack of flats within the second processing station for washing is continuously reversing rotational agitation.

16. The method as defined in claim 13 further comprising spraying of the rotating first stack of flats with a sanitizing spray immediately after said rinsing of the rotating first stack.

17. The method as defined in claim 13 further comprising spraying of the rotating second stack of flats with a sanitizing spray immediately after said rinsing of the rotating second stack.

18. The method as defined in claim 13 wherein said rotating the first stack of flats within the first processing station is performed at a higher rotational velocity than rotationally moving the first stack of flats within the first processing station for washing.

19. The method as defined in claim 13 wherein said rotating the second stack of flats within the second processing station is performed at a higher rotational velocity than rotationally moving the second stack of flats within the second processing station for washing.

20. The method as defined in claim 13 wherein said drying the first stack of flats by rotation thereof within the first processing station is performed at a rotational velocity greater than rotating the first stack of flats within the first processing station for rinsing thereof.

21. The method as defined in claim 13 wherein said drying the second stack of flats by rotation thereof within the second processing station is performed at a rotational velocity greater than rotating the second stack of flats within the second processing station for rinsing thereof.

22. A method for high capacity washing, sanitizing and drying of stacks of flats comprising:
(a) placing a first stack of flats to be cleaned into a first of two adjacently positioned processing chambers;
(b) removing of cleaning solution from the second of two adjacently positioned processing chambers;
(c) filling the first processing chamber with the cleaning solution removed from the second processing chamber;
(d) rotationally agitating the first stack of flats within the first processing station for washing thereof;
(e) placing a second stack of flats to be cleaned into the second processing chamber;
(f) removing of cleaning solution from the first processing chamber;
(g) filling the second processing chamber with the cleaning solution removed from the first processing chamber;
(h) rotationally agitating the second stack of flats within the second processing station for washing thereof;
(i) rotating the first stack of flats within the first processing station;
(j) rinsing the rotating first stack of flats with rinsing solution;
(k) applying a sanitizing spray to the rotating stack of first flats for sanitizing thereof;
(l) drying the first stack of flats by increasing the speed of rotation thereof within the first processing station;
(m) removing of the first stack of flats from the first processing station;
(n) placing a third stack of flats into the first processing station;
(o) removing of cleaning solution from the second processing station;
(p) filling of the first processing station with cleaning solution removed from the second processing station;
(q) rotating the second stack of flats within the second processing station;
(r) rinsing the rotating second stack of flats with rinsing solution;
(s) applying a sanitizing spray to the rotating second stack of flats for sanitizing thereof;
(t) drying the second stack of flats by increasing the speed of rotation thereof within the second processing station; and
(u) removal of the second stack of flats from the second processing station.

* * * * *

UNITED STATES PATENT AND TRADEMARK OFFICE

CERTIFICATE OF CORRECTION

PATENT NO. : 4,702,777
DATED : October 27, 1987
INVENTOR(S) : Henry Y. Kuhl

It is certified that error appears in the above—identified patent and that said Letters Patent is hereby corrected as shown below:

In Claim 1, sub-section (m) has not been indented properly.

In Claim 1, sub-section (m), line 57, after "sanitizing" insert -- spray conduit means --.

In Claim 1, sub-section (n), line 64, delete "conduit means".

Signed and Sealed this

Twenty-second Day of March, 1988

*Attest:*

DONALD J. QUIGG

*Attesting Officer*

*Commissioner of Patents and Trademarks*